United States Patent [19]

Yamada et al.

[11] Patent Number: 4,826,757

[45] Date of Patent: May 2, 1989

[54] PROCESS FOR PROCESSING SILVER HALIDE PHOTOGRAPHIC MATERIALS

[75] Inventors: Minoru Yamada; Kunio Seto, both of Kanagawa, Japan

[73] Assignee: Fuji Photo Film Co., Ltd., Kanagawa, Japan

[21] Appl. No.: 169,671

[22] Filed: Mar. 18, 1988

[30] Foreign Application Priority Data

Mar. 18, 1987 [JP] Japan ..... 62-61055

[51] Int. Cl.[4] ..... G03C 1/02; G03C 1/30; G03C 5/24; G03C 11/00

[52] U.S. Cl. ..... 430/428; 430/399; 430/429; 430/434; 430/435; 430/463; 430/484; 430/567; 430/621; 430/966

[58] Field of Search ..... 430/428, 399, 429, 489, 430/434, 435, 567, 621, 966, 463

[56] References Cited

U.S. PATENT DOCUMENTS

| | | | |
|---|---|---|---|
| 3,288,775 | 11/1966 | Anderau et al. | 544/218 |
| 4,081,280 | 3/1978 | Corluy et al. | 430/399 |
| 4,119,464 | 10/1978 | Sauerteig et al. | 430/451 |
| 4,297,437 | 10/1981 | Kaneko et al. | 430/399 |
| 4,433,048 | 2/1984 | Solberg et al. | 430/567 |
| 4,434,226 | 2/1984 | Wilgus et al. | 430/567 |
| 4,585,729 | 4/1986 | Sugimoto et al. | 430/502 |
| 4,600,687 | 7/1986 | Nakamura et al. | 430/523 |
| 4,613,562 | 9/1986 | Kuse et al. | 430/399 |
| 4,741,991 | 5/1988 | Wuelfing, Jr. | 430/399 |
| 4,775,612 | 10/1988 | Abe et al. | 430/428 |

*Primary Examiner*—Mukund J. Shah

*Attorney, Agent, or Firm*—Sughrue, Mion, Zinn, Macpeak, and Seas

[57] ABSTRACT

A process for processing silver halide photographic materials by processing, after development and fixing, the silver halide photographic materials with wash water or a stabilizing solution using a replenisher thereof of not more than 2 liters (including 0) per square meter of the photographic material and drying using a roller transporting type automatic processor, wherein the swelling percentage of the silver halide photographic material is not more than 200% and the total processing time from development to drying is not longer than 70 seconds.

10 Claims, No Drawings

PROCESS FOR PROCESSING SILVER HALIDE PHOTOGRAPHIC MATERIALS

FIELD OF THE INVENTION

This invention relates to a process for processing silver halide photographic materials, and more particularly to a process for processing silver halide photographic materials giving high efficiency in areas such as washing, etc., (hereinafter, referred to simply as washing efficiency) using a small amount of wash water or stabilization replenisher.

BACKGROUND OF THE INVENTION

In the case of processing sheet-shape light-sensitive materials such as direct photographing X ray light-sensitive materials, printing light-sensitive materials, etc., a roller-transporting type automatic processor (i.e., an automatic processor wherein when each sheet of sheet-shape light-sensitive materials is inserted into a light-sensitive material inlet portion of the automatic processor, the sheet is automatically transported by means of the rollers of the automatic processor) is generally used.

On the other hand, in recent developing processing for photographic light-sensitive materials, a process for performing washing or stabilization processing with a small amount of wash water or a stabilization replenisher has been required for saving water resources, saving energy, environmental preservation with the reduction of waste water, protection of silver resources, and further removing the restriction on a place for disposing an automatic processor by shortening or omitting plumbing, etc. Furthermore, recently the requirement for quickening the processing steps for photographic light-sensitive materials has been increased year by year. The requirement in processing for sheet-shape light-sensitive materials using the aforesaid roller transporting type automatic processor has been no exception in this ragard.

As a process for increasing washing efficiency with a small amount of wash water or a stabilization solution, a process utilizing a multistage countercurrent washing system as described in S.R. Goldwasser, *J. SMPTE,* 64, 248–253 (May, 1955), is known. This process has already been practiced in an automatic processor for processing a roll-form or cine-like long light-sensitive material such as color photographic materials.

However, in the case of the aforesaid roller transporting type automatic processor, washing with a small amount of wash water may be applicable but the use of the multistage countercurrent washing system as described above is practically difficult due to the cost and space requirements of the automatic processor.

On the other hand, when photographic processing (in particular, water washing or stabilization processing) is quickened, the fixing composition carried on a light-sensitive material in fix processing remains in the light-sensitive material without being sufficiently removed in the wash step or the stabilization step. This causes a problem of discoloring images formed during storage for a long period of time.

Various processes exist for quickly removing fixing components from light-sensitive materials by increasing the water washing efficiency. However, in any of these processes, there is a limit on shortening of washing time or stabilizing time and therefore, it is very difficult to obtain stable images causing less discoloring.

SUMMARY OF THE INVENTION

An object of this invention is therefore, to provide a processing process for light-sensitive materials capable of performing quick processing and which increases the storage stability of images obtained after processing by increasing the washing efficiency for light-sensitive materials with a small amount of wash water or stabilization solution.

A further object of this invention is to provide a processing process for light-sensitive materials giving good drying property in processing.

A still further object of this invention is to provide a processing process for light-sensitive materials capable of reducing the cost and space requirements of an automatic processor being employed for the process, and remove the restriction on a plate for disposing the automatic processor by shortening or omitting pipes for installing the automatic processor.

Another object of this invention is to provide a processing process for light-sensitive materials capable of completely recovering silver.

An additional object of this invention is to provide a processing process for light-sensitive materials capable of being easily and simply operated.

It has now been discovered that the aforesaid objects of this invention can be attained by a process for processing silver halide photographic materials which comprises processing, after developing and fixing, the silver halide photographic material with wash water or a stabilizing solution using a replenisher thereof of not more than 2 liters (including 0) per square meter of the photographic material and drying using a roller transporting type automatic processor, wherein the swelling percentage of the silver halide photographic material is not more than 200% and the total processing time from the development to drying is not longer than 70 seconds.

DETAILED DESCRIPTION OF THE INVENTION

It is known that in a conventional processing process for silver halide photographic materials, in which the washing step is performed using a large amount of wash water, the washing efficiency (i.e., the washing out efficiency for fixer components) is better in the case of wherein the silver halide photographic material, i.e., increasing the swelling percentage of the photographic material is not too strongly hardened (e.g., to 250%) or not too strongly performing hardening in processing solution (e.g., hardening in fixing solution) as described, for example, in A. Green et al, *Journal of Photographic Science,* Vol. 18, page 1 (1970)).

However, it has also been found that in the case of washing or stabilizing sheet-shape silver halide photographic materials with a small amount of wash water or stock water as according to this invention, the washing efficiency becomes unexpectedly better and the drying load is unexpectedly reduced in the case of strongly hardening the silver halide photographic materials by themselves (or without by processing solution). That is, the swelling percentage of the photographic materials is low. Furthermore, in the process according to this invention, hardening by the processing solution (e.g., a fixing solution) becomes unnecessary and therefore, the composition of the processing solution can be simplified.

Moreover, in this invention, by reducing the swelling percentage of the silver halide photographic material, a so-called dry to dry processing time, i.e., the whole processing time from development to drying can be as short as 70 seconds or less, preferably 60 seconds or less, and particularly preferably 50 seconds or less, which has never been heretofore practiced in photographic processing.

The swelling percentage of a photographic material according to this invention can be obtained by (a) subjecting the photographic material to an incubation treatment for 3 days at 38° C. and 50% RH, (b) measuring the thickness of the hydrophilic colloid layer(s) of the photographic material, (c) immersing the photographic material in distilled water at 21° C. for 3 minutes, (d) measuring the thickness of the hydrophilic colloid layer(s) again, (e) and determining the percentage of the change of the thickness of the hydrophilic colloid layer(s) between the thickness in step (d) and the thickness in step (b).

The swelling percentage of the silver halide photographic material in this invention is preferably from 30% to 200%, more preferably from 50% to 150%, and particularly preferably from 70% to 130%.

From the view point of quickening the processing time (e.g., shortening of processing time by the reduction of the drying load) and simplification of processing (e.g., omission of hardening in processing and the reduction of parts number of processing agents), it is preferred that the swelling percentage of the photographic light-sensitive material is 200% or less.

On the other hand, if the swelling percentage is too low, the speed or rate of development, fixing and washing are reduced. Hence, such a too low swelling percentage is undesirable.

In this invention, it is preferred that the silver halide photographic materials are strongly hardened so that that the swelling percentage is as described above before processing, and hardening of the photographic material does not occur during processing.

The swelling percentage of the silver halide photographic material can be easily controlled below 200% by, for example, increasing the amount of hardening agent in the photographic material. Examples of the hardening agent which is used for the purpose are aldehyde compounds, compounds having active halogen as described in U.S. Pat. No. 3,288,775, compounds having reactive ethylenically unsaturated group described in U.S. Pat. No. 3,635,718, etc., and other organic compounds such as halogencarboxyaldehydes (e.g., mucochloric acid), etc. In these compounds, the sulfone series hardening agents are preferred. Also, high molecular hardening agents can be preferably used.

As the high molecular hardening agents which are used in this invention, polymers having an active vinyl group or a group becoming the precursor therefor are preferred. In these polymers, those having an active vinyl group such as a vinylsulfone group, or a group becoming the precursor therefor, bonded to the main chain of the polymer by a long spacer as described in Japanese Patent Application (OPI) No. 142524/81 (the term "OPI" as used herein indicates an "unexamined published application") are particularly preferred.

The addition amount of the hardening agent for controlling the swelling percentage of the silver halide photographic material as defined in this invention depends upon the nature of the hardening agent being used and the nature of the gelatin of the hydrophilic colloid layer(s) being hardened.

In this invention, the silver halide emulsion layer(s) and/or other hydrophilic colloid layer(s) of the silver halide photographic material, can contain organic materials which will be washed out in the processing steps for the photographic material. When the organic material is gelatin, a sort of gelatin having no crosslinking reaction of gelatin by a hardehing agent is preferred. Such a gelatin includes acetylated gelatin and phthalated gelatin, the molecular weight thereof being preferably low.

On the other hand, as other high molecular weight materials, which are washed out at processing, other than the aforesaid gelatin, polyacrylamide as described in U.S. Pat. No. 3,271,158 and other hydrophilic polymers, such as polyvinyl alcohol, polyvinylpyrrolidone, etc., can be effectively used. Also, saccharides such as dextran, saccharose, prulane, etc., are also effective. In these materials, polyacrylamide and dextran are preferred and polyacrylamide is particularly preferred. The average molecular weight of these materials is preferably not more than 20,000, and more preferably not more than 10,000. The washing out amount of these materials at processing is preferably from 10% to 50%, more preferably from 15% to 30% of the total amount of the organic materials coated together with silver halide grains.

The layer containing the organic material which is washed out at processing as described above, may be a silver halide emulsion layer or a surface protective layer. However, when the total coating amount of the aforesaid organic material is same, the case of incorporating the organic material in the surface protective layer and the emulsion layer is preferred compared to the case of incorporating it in the emulsion layer only. The case of incorporating the organic material in the surface protective layer only, is more preferred. Also, in the silver halide photographic material having emulsion layers of multilayer structure, when the total coating amount of the organic material is same, and the organic material is incorporated in the emulsion layers, it is preferred that the emulsion layer nearer a surface protective layer contains a larger amount of the organic material.

The silver halide for the silver halide photographic materials processed according to this invention may be silver chloride, silver bromide, silver iodide, silver chlorobromide, silver iodobromide, silver chloroiodo-bromide, etc.

The silver halide photographic material having a swelling percentage of not more than 200, which is processed according to this invention, has a general tendency of giving lower image density per unit silver amount (i.e., lower covering power than that of a silver halide photographic material having a higher swelling percentage than the aforesaid value). Thus, from the viewpoint of giving high density even in the case of low swelling percentage, it is preferred to use tabular silver halide grains, such as those described in *Research Disclosure,* (R.D. No. 22534) (January, 1983), and Japanese Patent Application (OPI) Nos. 127921/83, 113927/83, and 113928/83.

The aspect ratio of the tabular grain is given by the ratio of the mean value of the diameters of circles having the same areas as the projected areas of the tabular grains, to the mean value of the thickness of the tabular grains. The mean aspect ratio of the tabular silver halide grains in this invention is preferably from 4 to less than 20, and more preferably from 5 to less than 10. Also, the thickness of the tabular grains is preferably not more than 0.3 μm, and more preferably not more than 0.2 μm.

In this invention, the proportion of the tabular silver halide grains in the silver halide emulsion is preferably at least 80% by weight, and more preferably at least 90% by weight, based on the weight of the whole silver halide grains.

Such a tabular grain silver halide emulsion can be prepared by properly combining the methods known in the field of the art.

For example, such a tabular grain silver halide emulsion is described in Cugnac and Chateau, "Evolution of the Morphology of Silver Bromide Crystals During Phisical Ripening", *Science et Industrie Photography*) Vol. 33, No. 2, 121–125 (1962) Duffin, *Photographic Emulsion Chemistry,* pages 66–72 (1966) published by Focal Press, A. P. H. Trivelli and W. F. Smith, *Photographic Journal,* Vol. 80, 285 (1940), etc., and can be easily prepared by the methods described in Japanese Patent Application (OPI) Nos. 127921/83, 113927/83, and 113928/83.

Also, the aforesaid tabular silver halide grains are obtained by forming seed crystals containing 40% or more by weight tabular grains in an atmosphere of relatively low pBr value (e.g., not more than 1.3 in pBr), and then simultaneously adding thereto a solution of silver salt and a solution of halide while keeping the same pBr value.

It is desirable that during the grain growing stage, the solution of silver salt and the solution of halide are added so that new crystal nuclei are not formed.

The size of the tabular silver halide grains can be controlled by suitably controlling the temperature of the silver halide formation system, selecting the kind and amount of the solvent, and suitably controlling the addition rates of a silver salt and halide at the growth of the silver halide grains.

As preferred silver halide emulsions capable of giving high covering power even for the silver halide photographic materials having a swelling percentage of not more than 200%, there are, in addition to the aforesaid tabular grain silver halide emulsions, silver halide emulsions containing silver halide grains having a mean grain size (measured by, for example, a projected area method or a number averaging method) of not more than 0.8 μm, preferably from 0.05 μm to 0.7 μm, and more preferably from 0.1 μm to 0.6 μm. The form of the silver halide grains having such a mean grain size may be spherical, cubic, octahedral, tetradecahedral, or potato-like shaped grains, or further may be a mixture of these silver halide grains. In this case, it is preferred that the silver halide grains having such a mean grain size account for at least 70% of the total silver halide grains in the silver halide photographic material of this invention.

The silver halide emulsions containing the aforesaid spherical, cubic, octahedral or tetradecahedral silver halide grains having a mean grain size of not more than 0.8 μm can be prepared by the methods described in P. Glafkides, *Chimie et Physique Photographique,* published by Paul Montel Co., 1967; V. L. Zelikman et al. *Making and Coating Photographic Emulsion,* published by Focal Press, 1964, etc., in addition to the references noted above.

The silver halide emulsion containing silver halide grains having a mean grain size of not more than 0.8 μm, may be a mixture of silver halide emulsions each containing silver halide grains each having different mean grain size, or may be a mixture of two or more monodisperse silver halide emulsions containing silver halide grains having different mean grain size. In this invention, the monodisperse emulsion is a silver halide emulsion having a dispersion coefficient (standard deviation/mean grain size) of preferably not more than 0.2 μm, and more preferably not more than 0.1 μm.

Furthermore, the silver halide emulsion for use in this invention may be a mixture of a silver halide emulsion containing silver halide grains having a mean grain size of not more than 0.8 μm and the aforesaid tabular grain silver halide emulsion.

During the step of forming or physical ripening of the aforesaid silver halide grains, a cadmium salt, a zinc salt, a lead salt, a thallium salt, an iridium salt (or a complex salt thereof), a rhodium salt (or a complex salt thereof), or an iron salt (or a complex salt thereof) may be added to the system.

The silver halide emulsion for use in this invention can, if necessary, be chemically sensitized. For the chemical sensitization, a gold sensitization by a gold compound, a noble metal sensitization by another noble metal (such as iridium, platinum, palladium, etc.), a sulfur sensitization by a sulfur-containing compound, a reduction sensitization (by a complex salt, polyamine, etc.), or a combination thereof can be used.

The silver halide photographic material which is processed by the process of this invention contains silver in an amount of preferably from 0.5 $g/m^2$ to 5 $g/m^2$ (per one side of the coated photographic material), and more preferably from 1 $g/m^2$ to 3 $g/m^2$ (per one side of the coated photographic material).

An amount of silver greater than 5 $g/m^2$ is undesirable from the view point of cost and for the purpose of saving silver resources. On the other hand, if the silver halide is less than 0.5 $g/m^2$, the image density and contrast are reduced.

The silver halide photographic emulsions for use in this invention can contain various compounds for preventing the formation of fog and stabilizing the photographic properties during the production, storage, and processing of the photographic materials. For example, there are various antifoggants and stabilizers such as azoles (e.g., benzothiaxoliums, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), etc.); mercaptopyrimidines; mercaptotriazines; thioketo compounds (e.g., oxazolinethione); azaindenes (e.g., triazaindenes, tetraazaindenes (in particular, 4-hydroxy-substituted (1,3,3a,7)tetraazaindenes), pentaazaindenes, et.); benzenethiosulfonic acid; benzenesulfinic acid; benzenesulfonic acid amide; etc.

Furthermore, the compounds described in U.S. Pat. Nos. 3,954,474 and 3,982,947 and Japanese Patent Publication No. 28660/77 can be also used as the aforesaid compounds.

In particular, nitron and the derivatives thereof described in Japanese Patent Application (OPI) Nos. 76743/85 and 87322/85, mercapto compounds described in Japanese Patent (OPI) No. 80839/85, heterocyclic compounds described in Japanese Patent Application (OPI) No. 164735/82, and complex salts of heterocyclic compounds and silver (e.g., 1-phenyl-5-mercaptotetrazole silver) can be preferably used for the aforesaid purpose.

Also, it is preferred that the silver halide emulsions for use in this invention are spectrally sensitized by sensitizing dye(s).

Particularly useful sensitizing dyes are cyanine dyes, merocyanine dyes, and complex merocyanine dyes.

Specific examples of the sensitizing dyes are described in *Research Disclosure,* (R.D. No. 17643), page 23 (December, 1978) and U.S. Pat. Nos. 4,425,425 and 4,425,426.

The sensitizing dyes are generally added to the silver halide emulsions before coating the emulsions on a proper support. In this case, the sensitizing dyes may be added to the emulsions during the step of chemical ripening or the step of forming silver halide grains.

The silver halide emulsion layers of the photographic light-sensitive materials which are processed by the process of this invention, may further contain plasticizers such as a polymer or an emulsion thereof (e.g., an alkyl acrylate latex) or polyols (e.g., trimethylolpropane) in order to improve the pressure characteristics.

The silver halide emulsion layer and other hydrophilic colloid layers of the photographic light-sensitive materials in this invention may further contain various surface active agents for the purposes of coating aid, antistatic agent, the improvement of dispersibility, the sticking prevention, the improvemnnt of sliding property, and the improvement of photographic performance (e.g., the development acceleration, the increase of contrast, and the increase of sensitivity). Specific examples of the surface active agents are described in *Research Disclosure,* (R.D. No. 17643, XI(A) and XIII(A)), pages 26–27 (December, 1978) and *Research Disclosure,* (R.D. No. 18431, III), page 436 (August, 1979).

As the organic antistatic agents which can be used with the photographic light-sensitive materials of this invention, are the fluorine-containing surface active agents described in Japanese Patent Application (OPI) Nos. 109044/87 and 215272/87, the nonionic surface active agents described in Japanese Patent Application (OPI) Nos. 76742/85, 80846/85, 80848/85, 80839/85, 76741/85, 208743/83, 172343/87, 173459/87, 215272/87 and conductive polymers or latexes (nonionic, anionic, cationic, and amphoteric) described in Japanese Patent Application (OPI) Nos. 204540/82 and 32462/86 can be preferably used.

Also, as inorganic antistatic agents, conductive tin oxide, zinc oxide and composite oxides formed by doping these metal oxides with antimony, etc., as described in Japanese Patent Application (OPI) No. 118242/82 may be used.

In this invention, the use of fluorine-containing surface active agents as the antistatic agent is particularly preferred.

The photographic light-sensitive material of this invention may further, if necessary, have interlayer(s), a filter layer, an antihalation layer, etc.

The photographic light-sensitive materials of this invention may further contain matting agents. Examples of the matting agent are fine particles of organic compounds such as polymethyl methacrylate, copolymer of methyl methacrylate and methacrylic acid, starch, etc., as described in U.S. Pat. Nos. 2,992,101, 2,701,245, 4,142,894, and 4,396,706 and fine particles of inorganic compounds such as silica, titanium dioxide, strontium barium sulfate, etc.

Particle sizes of these matting agents are from 1.0 μm to 10 μm, and particularly preferably from 2 μm to 5 μm.

In the process of this invention, a black-and-white developer is used for developing the silver halide photographic materials. The black-and-white developer for use in this invention contains a developing agent such as dihydroxybenzenes, 3-pyrazolidones, and p-aminophenolic developing agents.

Examples of the dihydroxybenzene developing agents for use in this invention are hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, etc., but hydroquinone is particularly preferred.

Also, example of the 3-pyrazolidone developing agents for use in this invention are;

1-phenyl-3-pyrazolidone,
1-phenyl-4,4-dihydroxymethyl-3-pyrazolidone,
1-p-tolyl-4,4-dihydroxymethyl-3-pyrazolidone,
1-phenyl-4 hydroxymethyl-4-methyl-3-pyrazolidone,
1-phenyl-4,4-dimethyl-3-pyrazolidone,
1-phenyl-2-hydroxymethyl-4,4-dimethyl-3-pyrazolidone,
1-phenyl-2-morpholinomethyl-4,4-dimethyl-3-pyrazolidone,
1-phenyl-2-morpholinomethyl-4-methyl-3-pyrazolidone,
1-phenyl-2 hydroxymethyl-4-methyl-3-pyrazolidone,
1-phenyl-5,5-dimethyl-3-pyrazolidone,
1-phenyl-5-methyl-3-pyrazolidone,
1-p-tolyl-4-methyl-4-hydroxymethyl-3-pyrazolidone,
1-p-hydroxyphenyl-4,4-dimethyl-3-pyrazolidone,
1-m-tolyl-4-methyl-4-hydroxymethyl-3-pyrazolidone,
1-p-methoxyphenyl-4-methyl-4-hydroxymethyl-3-pyrazolidone,
1-(3,5-dimethyl)phenyl-4-methyl-4-hydroxymethyl-3-pyrazolidone, etc.

Examples of the p-aminophenolic developing agents for use in this invention are N-methyl-p-aminophenol, p-aminophenyl, N-(β-hydroxyethyl)-p-aminophenol, N-(4-hydroxyphenyl)glycine, 2-methyl-p-aminophenol, p-benzylaminophenol, etc. However, N-methyl-p-aminophenol is preferred.

The developing agent is usually used in an amount of from 0.01 mol/l to 1.2 mol/l.

The developer for use in this invention may contain a sulfite as a preservative. Examples of the preservative are sodium sulfite, potassium sulfite, lithium sulfite, ammonium sulfite, sodium hydrogensulfite, potassium metahydrogensulfite, etc. The amount of the sulfite is not less than 0.2 mol/l, and preferably not less than 0.4 mol/l. The upper limit of the sulfite is preferably 2.5 mols/l.

The pH of the developer for use in this invention is preferably in the range of from 9 to 13, and more preferably from 10 to 12.

To adjusting the pH of the developer for use in this invention, an alkali agent may be used. Examples of the alkali agent are sodium hydroxide, potassium hydroxide, sodium carbonate, potassium carbonate, sodium tertiary phosphate, and potassium tertiary phosphate.

The developer for use in this invention may further contain a buffer such as borates described in Japanese Patent Application (OPI) No. 186259/87, saccarose, acetoxime, and 5-sulfosalicylic acid described in Japanese Patent Application (OPI) No. 93433/85, phosphates, and carbonates.

Also, the developer may further contain a dialdehyde series hardening agent or the hydrogensulfite-addition product thereof. Specific examples of such a hardening agent are glutaraldehyde and the hydrogen-sulfite-addition product thereof.

The developer for use in this invention may further contain a development inhibitor such as sodium bromide, potassium bromide, potassium iodide, etc., and organic solvent such as ethylene glycol, diethylene glycol, triethylene glycol, dimethylformamide, methylcellosolve, hexylene glycol, ethanol, methanol, etc., an antifoggant such as mercapto series compounds (e.g., 1-phenyl-5-mercaptotetrazole and sodium 2-mercaptobenzimidazole-5-sulfonate), indazole series compounds (e.g., 5-nitro-indazole), benztriazole series compounds (e.g, 5-methyl-benztrizaole). Furthermore, the developer may, if necessary, contain toning agent, a surface active agent, a defoaming agent, a water softener, and an amino compound described in Japanese Patent Application (OPI) No. 106244/81.

Furthermore, the developer for use in this invention may contain the compounds described in Japanese Patent Application (OPI) No. 24347/81, as a silver stain preventing agent.

The developer for use in this invention may further contain an amino compound such as alkanolamine, etc., as described in Japanese Patent Application (OPI) No. 106244/81.

Moreover, the developers for use in this invention may contain the compounds described in L. F. A. Mason, *Photographic Processing Chemistry,* Focal Press, pages 226–229 (1966), U.S. Pat. Nos. 2,193,015 and 2,592,364, and/or Japanese Patent Application (OPI) NO. 64933/73.

The processing composition is usually separated into plural parts. This is due to the occurrence of deterioration and change of processing components by the interaction of the components contained in the processing composition before use. Each part is stored stably in each state at use, the plural parts of the processing composition are successively dissolved in water with mixing. Finally, the solution is adjusted to a definite volume with water and the solution thus obtained is used as the processing solution.

Each part of the processing composition is usually in a concentrated state as compared with the processing solution for use.

With processing of light-sensitive materials in an automatic processor, the concentrated solutions (the concentrated parts of the developer and fix solution) are supplied together with diluting water to the developer tank and fixer tank for replenishing the consumed portions of the processing solutions. In this case, it is most preferred for the simplification of equipment and keeping accurate replenishment that the concentrated developer is composed of one part. The concentrated developer may be composed of two parts and they may be diluted with water prior to use. However, in the case of using a concentrated developer composed of two parts, two pumps are required for sending the parts. Also the parts must be separated from each other just before use. This causes problems in that the operation becomes troublesome and the uutomatic processor becomes complicated.

For the simplification of the constitution of processing composition and further facilitation of the preparation of processing solution, the silver halide photographic material of this invention is very advantageous since the photographic material is strongly hardened (i.e., has the low swelling percentage) and hence, hardening in processing is unnecessary. That is, if, for example, glutaraldehyde (which is usually used for hardening in a developer) becomes unnecessary, a developer composition usually composed of three parts can be composed of two parts. Furthermore if the aforesaid 3-pyrazolines are used as the developing agent, the developer compositions can be composed of one concentrated part.

Furthermore, even when an aluminum salt(which is generally used for hardening in a fix solution) is used, the pH of a fix solution can be increased to such an extent that the ratio of the photographic material in this invention relying on the hardening in fixing is reduced. Accordingly, the stability of a thiosulfate, which is the main fixing agent, is increased to an extent, whereby the fixing composition can also be composed of one concentrated part.

Therefore, in a preferred embodiment of this invention, a hardening agent is not used in a developer. Also, in a more preferred embodiment of this invention, the fix composition is composed of one concentrated part.

In this invention, the term "development time" is the time required from the immersion of the photographic light-sensitive material in the developer of an automatic processor to its immersion of a subsequent fix solution. The term "fixing time" is the time required from the immersion of the photographic material in a fixing solution to its immersion in subsequent wash water (or stabilization solution). Also, the term "washing time" is the time that the photographic material is immersed in wash water.

Also, the term "drying time" is the time that the photographic material is in a drying zone of an automatic processor into which a hot blast of from 35° C. to 100° C., preferably from 40° C. to 80° C. is blown.

The developing temperature and time is preferably from about 25° C. to about 50° C. for a period of from 2 minutes to 6 seconds, more preferably from 30° C. to 40° C. for a period of from 60 seconds to 6 seconds, and far more preferably 30° C. to 40° C. for a period of from 30 seconds to 6 seconds.

A "fix solution" is an aqueous solution containing a thiosulfate and the pH thereof is 3.8 or higher, preferably from 4.2 to 7, and more preferably from 4.2 to 6.5.

As the fixing agent, sodium thiosulfate and ammonium thiosulfate are used, but from the point of fixing speed, ammonium thiosulfate is particularly preferred. The amount of the fixing agent can be properly changed and is generally from about 0.1 mol/l to about 6 mol/l.

The fix solution may contain a water-soluble aluminum salt acting as hardening agent and examples thereof are aluminum chloride, aluminum sulfate, and potassium alum.

For the fix solution, tartaric acid, citric acid, gluconic acid and the derivatives thereof can be used singly or as a mixure thereof. The aforesaid compound is used in an amount of effectively 0.005 mol or more, and more effectively from 0.01 to 0.03 mol per liter of the fix solution.

Specific examples of the aforesaid compounds are tartaric acid, potassium tartarate, sodium tartarate, potassium sodium tartarate, citric acid, sodium citrate, potassium citrate, lithium citrate, and ammonium citrate.

The fix solution for use in this invention may further contain, if necessary, a preservative (e.g., sulfites, hydrogen-sulfites), a pH buffer (e.g., acetic acid and boric acid), a pH adjusting agent (e.g., sulfuric acid), a chelating agent having a water softening faculty, and the compound described in Japanese Patent Application (OPI) No. 78551/87.

The fixing temperature and time are the same as those of development and are preferably from about 20° C. to about 50° C. for a period of from 2 minutes to 6 seconds, more preferably from 30° C. to 40° C. for a period of from 60 seconds to 6 seconds, and far more preferably from 30° C. to 40° C. for a period of from 30 seconds to 6 seconds.

When the fix composition is composed of one concentrated part, the pH of the concentrated part is not lower than 4.0, and preferably not lower than 4.65 for stably storing the concentrated part. If the pH of the concentrated part is lower than 4.5, when the concentrated part is stored for a long period of time, a thiosulfate contained therein is decomposed and the concentrated part is finally sulfurized. On the other hand, if the pH is in the range of not lower than 4.5, the generation of sulfite gas is less and the working conditions become better. The upper limit of the pH value is not critical. However, if the pH is too high at fixing, the pH of the layer(s) becomes high at washing, causing an increase in the swelling ratio of the layers, which results in increase in the drying load. Thus, the upper limit of the pH is about 7.

In addition, in a fix solution containing an aluminum salt as hardening agent, the proper pH for preventing the deposition or precipitation of the aluminum salt is up to 5.5.

The developer and the fix solution for use in this invention may be usable solutions from the first without need of the concentrated parts and diluting water as described above (i.e., may be the type of supplying as original or unconcentrated solutions).

In this invention, after development and fixing, the photographic materials are subjected to washing or stabilization processing.

For washing and stabilization, any known systems can be used and water containing various additives known in the field of art can be used as wash water or a stabilization solution.

In this invention, it is preferred from the viewpoint of saving water to use water provided with antifungal means for washing or stabilizing the photographic light-sensitive materials.

According to this invention, water saving of a replenisher amount of not more than 2 liters per square meter of photographic light-sensitive material is possible. Pumbling required for installing the automatic processor becomes unnecessary, and the washing efficiency becomes greatly improved. Furthermore, water provided with antifungal means is supplied as diluting water for preparing the developer and the fix solution and also as wash water or stabilization solution from one common stock tank in this invention. Accordingly, the automatic processor can be made more compact.

When water provided with antifungal means is used as wash water or stabilization solution, the formation of fur, etc., can be effectively prevented. Hence the amount of the replenisher for wash water or the stabilizing solution can be reduced from 0 to 2 liters, and preferably from 0 to 1 liter per square meter of the photographic materials.

In the case that the amount of replenisher is 0, a so-called "stock water" processing of substantial no replenishment is performed, wherein no replenishment is performed except a proper replenishment for a portion of wash water in the wash tank(s) reduced by natural evaporation, etc.

When the photographic materials are washed with a smaller amount of wash water in the process of this invention, it is preferred to use a squeeze roller washing tank as described in Japanese Patent Application (OPI) No. 324607/87.

Furthermore, a part of or the entire amount of the overflow liquid from the wash tank or stabilization tank, which is formed by replenishing water provided with antifungal means to the wash tank or the stabilization tank, can be utilized as the processing liquid having a fixing faculty in the previous processing step, such as described in Japanese Patent Application (OPI) No. 163217/86. Such a system is more preferred, since the aforesaid stock water can be saved and the amount of waste solution becomes less.

As the antifungal means, a ultraviolet ray irradiation method as described in Japanese Patent Application (OPI) No. 263939/85, a method of using magnetic field as described in Japanese Patent Application (OPI) No. 263940/85, a method of forming pure water by using an ion-exchange resin as described in Japanese Patent Application (OPI) No. 131632/86, and a method of using an antifungal agent as described in Japanese Patent Application (OPI) Nos. 115154/86, 153952/87, 220951/87 and 209532/87 can be used.

Moreover, in this invention the antibacterial agents, antifungal agents, and surface active agents described in L. E. West, "Water Quality Criteria", *Photographic Science & Engineering,* Vol. 9, No. 6, (1965) N. W. Beach, "Microbiologial Growths in Motion-Picture Processing", *SMPTE Journal,* Vol. 85 (1976), R.O. Deegan, "Photo Processing Wash Water Biocides", *Journal of Imaging Technology,* Vol. 10, No. 6 (1984), and Japanese Patent Application (OPI) Nos. 8542/82, 58143/82, 105145/83, 132146/82, 18631/83, 97530/82, and 157244/82 can be used for wash water or stabilization solution.

Furthermore, isothiazoline compounds as described in R. T. Kreman, *Journal of Imaging Technology,* 10, (6), 242 (1984), isothiazoline compounds as described in *Research Disclosure,* Vol. 205, (R.D. No. 20526) (May, 1981), isothiazoline compounds described in *Research Disclosure,* Vol. 228, (R.D. No. 22845) (April, 1983), and the compounds described in Japanese Patent Application (OPI) No. 209532/87 can be also used as microbicides or antifungal agents.

Specific examples of the microbicide are phenol, 4-chlorophenol, pentachlorophenol, cresol, o-phenylphenol, chlorophene, dichlorophene, formaldehyde, glutaraldehyde, chloroacetamide, p-hydroxybenzoic acid ester, 2-(4-thiazolyl)-benzimidazole, benzoisothiazoline-3-one, dodecyl-benzyl-dimethylammonium chloride, N-(fluorodichloromethylthio)-phthalimide, and 2,4,4'-trichloro-2'-hydroxydiphenyl ether.

Also, other compounds, such as described in Hiroshi Horiguchi, *Bokin Bobai no Kagaku* (*Antibacterial Antifungal Chemistry*), published by Sankyo Shuppan K.K. 1982 and *Bokin Bobai Gijutsu Handbook* (*Antibacterial Antifungal Technology Handbook*), edited by Antibacterial and Antifungal Society of Japan, published by Giho Do, 1986, can be used for the aforesaid purpose.

In this invention, it is preferred from a viewpoint of space requiremnts to use water which was subjected to the antifungal means and stored in a stock tank as diluting water for the developer and the fix solution and also as wash water (or stabilization solution). However, diluting water subjected to antifungal means and wash water (or the stabilizing solution) can be separately stored in separate tanks or as the case may be, city water may be directly used for one of them.

When they are separately stored, wash water (or the stabilizing solution) may be subjected to antifungal means and may further contain the aforesaid additives.

For example, wash water or the stabilizing solution may contain a chelate compound having a chelate stability constant (log K) for aluminum of not lower than 10. Such a chelate compound is effective for preventing the occurrence of white precipitations in wash water when the fix solution contains an aluminum compound as a hardening agent.

Specifc examples of the chelating agent are ethylenediaminetetraacetic acid (log K=16.1), cyclohexanediaminetetraacetic acid (17.6), diaminopropanoltetraacetic acid (13.8), diethylenetriaminepentaacetic acid (18.4), triethylenetetraminehexaacetic acid (19.7) and the sodium salts, potassium salts, and ammonium salts thereof. The addition amount of the chelating agent is preferably from 0.01 to 10 g/l, and more preferably from 0.1 to 5 g/l.

Also, silver image stabilizers described in Japanese Patent Application (OPI) Nos. 434542/83, 114035/83 and 83534/86, can be incorporated in wash water.

Furthermore, wash water for use in this invention can further contain various surface active agents for preventing the formation of water drop stains on the processed product. As the surface active agents, cationic, anionic, nonionic, and amphoteric surface active agents may be used. Specific examples of the surface active agents are described in *Kaimen Kasei Zai* (*Surface Active Agent*) Handbook, published by Kogaku Tosho K.K.

The aforesaid stabilizing solution may contain various compounds for stabilizing images formed. Typical examples of these compounds are various buffers for adjusting the layer pH (e.g., from 3 to 8), such as borates, metaborates, borax, phosphates, carbonates, potassium hydroxide, sodium hydroxide, aqueous ammonia, monocarboxylic acids, dicarboxylic acids, polycarboxylic acids, and a combination thereof, as well as formalin and aldehyde.

Other examples of the additives are chelating agents, sterilizers (thiazole series, isothiazole series, halogenated phenol, sulfanylamide, benzotriazole, etc.), surface active agents, optical whitening agents, hardening agents, etc. Two or more of the compounds described above, may be used for a same or different purposes.

Also, it is preferred for improving the storage stability of images to use various ammonium salts such as ammonium sulfite, ammonium thiosulfate, etc., in the stabilizing solution as a film pH controlling agent.

In the process of this invention, the washing or stabilizing temperature and time are preferably from 0° C. to 50° C. for a period of from 2 minutes to 6 seconds, more preferably from 15° C. to 40° C. for a period of from 60 seconds to 6 seconds, and most preferably from 15° C. to 40° C. for a period of from 30 seconds to 6 seconds. In particular, according to this invention, the washing or stabilizing time can be preferably reduced below 15 seconds.

According to the process of this invention, the photographic material thus developed, fixed, and washed was dried after squeezing out the wash water (i.e., after being passed through squeeze rollers). Drying is performed at a temperature of from about 40° C. to about 100° C., and the drying time can be properly changed according to the circumference condition. However, the drying time is usually from about 5 seconds to 1 minute, and more preferably from about 5 seconds to 30 seconds at from 80° C. to 40° C.

The process of this invention has a further excellent effect, i.e., since the swelling percentage of the photographic light-sensitive material is lower, the drying time can be more greatly reduced.

There is no particular restriction on the photographic light-sensitive materials to which the process of this invention is applicable. However, general black-and-white photographic materials are preferably used. For example, the general black-and-white negative photographic materials, direct photographing X-ray photographic films, indirect photographing X-ray photographic films may be preferably used with this invention. Photographic films for CRT, X-ray duplicate photographic materials, printing photographic materials (e.g., scanner photographic materials, dot photographing light-sensitive materials, line photographing light-sensitive materials, and photographic light-sensitive materials for duplicate), etc., and black-and-white photographic papers are examples of the above.

The invention is further explained by the following examples. However, it is to be understood that the present invention is not to be limited in anyway by these examples.

EXAMPLE 1

Preparation of Emulsion Comprising Potato-like Shaped Silver halide Grains (Emulsion A)

In a vessel kept at 48° C., were placed 900 ml of water, 20 g of gelatin, 30 g of potassium bromide, and 3.91 g of potassium iodide and further, 35 g of silver nitrate was added as an aqueous solution thereof, with stirring over a period of 4 minutes. Furthermore, an aqueous solution of ammoniacal silver nitrate (165 g as silver nitrate) and an aqueous solution of potassium bromide were simultaneously added thereto, by a double jet method over a period of 5 minutes. Thereafter, soluble salts were removed by sedimentation at 35° C. After raising the temperature of the system to 40° C., 100 g of gelatin was added thereto, and the pH thereof was adjusted to 6.7.

The silver halide grains in the emulsion thus formed were in potato-like form, the mean diameter of the spheres having the same volume as each grains was 0.82 μm, and the content of silver iodide was 2 mol %. The emulsion was chemically sensitized using gold sensitization and sulfur sensitization together to provide Emulsion A.

Preparation of Tabular Grain Silver Iodobromide Emulsion (Emulsion B)

In a vessel kept at 60° C. were placed 1 liter of water, 30 g of gelatin and 6 g of potassium bromide and then an aqueous solution of silver nitrate (5 g as silver nitrate) and an aqueous potassium bromide solution containing 0.15 g of potassium iodide were added thereto with stirring by a double jet method over a period of one minutes. Furthermore, an aqueous solution of silver nitrate (145 g as silver nitrate) and an aqueous potassium iodide were added thereto by a double jet method. In this case the addition rate was adjusted so that the flow rate at the end of addition became 5 times the flow rate at the initiation of the addition. Thereafter, solution salts were removed by sedimentation at 35° C. Then, the temperature thereof was raised to 40° C. and after further adding thereto 70 g of gelatin, the pH was adjusted to 6.7. The emulsion thus obtained contained tabular grains having a diameter of the projected area of 0.98 μm and a mean thickness of 0.138 μm. Also the content of silver iodide was 3 mol %. The emulsion was chemically sensitized by gold sensitization and sulfur sensitization together in order to provide Emulsion B.

Preparation of Photographic Materials 1 to 6

For the surface protective layer, an aqueous gelatin solution was used containing, in addition to gelatin, polyacrylamide having a mean molecular weight of 8,000, sodium polystyrenesulfonate, fine particles (mean particle size of 3.0 μm) of polymethyl methacrylate, polyethylene oxide, and a hardening agent. To each of Emulsions A and B, the sensitizing dye and potassium iodide were added in the ratio shown in Table 1 below. Furthermore, by adding 4-hydroxy-6-methyl-1,3,3a,7-tetraazaindene, 2,6-bis(hydroxyamino)-4-diethylamino-1,3,5-triazine, and nitron as stabilizers, trimethylolpropane as a dry fog preventing agent, a coating aid, and hardening agents in different levels for changing the swelling percentage, each coating composition was prepared. The coating composition for emulsion layer and the coating composition for protective layer prepared in the aforesaid step were simultaneously coated on both surfaces of a polyethylene terephthalate support in order to form the emulsion layer and surface protective layer and dried to provide Photographic Materials 1 to 6. Each coated amount of silver for each photographic material is shown in Table 1 below.

TABLE 1

| *1 P.M. | *2 Em. | Sensitizing Dye*3 | KI (mg/mol-Ag) | Swelling Percentage | Coated Ag Amount*4 ($g/m^2$) |
|---|---|---|---|---|---|
| 1 | A | 170 mg/mol-Ag | 70 | 230 | 4.0 |
| 2 | A | " | 70 | 100 | 4.0 |
| 3 | B | 250 mg/mol-Ag | 100 | 230 | 2.0 |
| 4 | B | " | 100 | 150 | 2.0 |
| 5 | B | " | 100 | 120 | 2.0 |
| 6 | B | " | 100 | 70 | 2.0 |

Note:
*1: Photographic Material
*2: Emulsion
*3: Anhydro-5,5'-dichloro-9-ethyl-3,3'-di(3-sulfopropyl)oxacarbocyanine hydroxide sodium salt
*4: per one side Each of the photographic materials was subjected to X-ray exposure and then to Processing I shown below.

Processing I was as follows.

| Developer Composition (for 38 liters) | |
|---|---|
| Part A: | |
| Potassium Hydroxide | 1107 g |
| Potassium Sulfite | 1680 g |
| Sodium Hydrogencarbonate | 285 g |
| Boric Acid | 38 g |
| Diethylene Glycol | 456 g |
| Ethylenediaminetetraacetic Acid | 63.5 g |
| 5-Methylbenzotraizole | 2.28 g |
| Hydroquinoene | 1140 g |

-continued

| Developer Composition (for 38 liters) | |
|---|---|
| Water to make | 9.50 liters |
| Part B: | |
| Glacial Acetic Acid | 416.5 g |
| Diethylene Glycol | 644.5 g |
| 5-Nitroindazole | 9.5 g |
| 1-Phenyl-3-pyrazolidone | 57 g |
| Water to make | 1035 ml |
| Part C: | |
| Glutaraldehyde | 187.3 g |
| Sodium Metahydrogensulfite | 478.8 g |
| Water to make | 950 ml |
| Starter: | |
| Acetic Acid | 270 g |
| Potassium Bromide | 300 g |
| Water to make | 1.5 liters |

Preparation of Developer

In a 50-liter stock tank for replenisher was placed 20 liters of water. Then part A, Part B, and Part C as described above were successively added and dissolved therein. Finally, water was added thereto to provide 38 liters of an aqueous solution to prepare a replenisher for developer (pH 10.30).

The developer composed of 1 liter of the replenisher from developer thus prepared and added to 20 ml of the aforesaid starter was first filled in the developer tank of an automatic processor (pH 10.15). Therafter, the replenisher was supplied as required for processing of each photographic material in an amount of 45 ml per sheet of 10 inch × 12 inch.

Fix Solution

| | |
|---|---|
| Part A: | |
| Ammonium thiosulfate (70 wt/vol %) | 7.6 liters |
| Disodium Ethylenediamine-tetraacetate Dihydrate | 0.76 g |
| Sodium Sulfite | 570 g |
| Boric Acid | 380 g |
| Sodium Hydroxide | 254.6 g |
| Acetic Acid | 570 g |
| Water to make | 9.5 liters |
| Part B: | |
| Aluminum Sulfate | 380 g |
| Sulfuric Acid (36 N) | 148.2 g |
| Water to make | 1.9 liters |

Preparation of Fix Solution

In a 50 liter stock tank for replenisher, Part A and part B as described above were successively added with stirring. Finally water was added in order to make 38 liters of the solution providing a replenisher for fix solution.

A solution having the same composition as the replenisher was filled in the fix tank of the automatic processor (pH 4.25). Thereafter, the aforesaid replenisher for fix solution was supplied as required for processing of each of photographic materials, in an amount of 60 ml per sheet of 10 inch × 12 inch.

Wash was carried out in the following two manners.

Wash I-(1): During processing the photographic materials, city water was supplied to the washing tank of the automatic processor in an amount of 3 liters/min. A squeeze roller washing tank was not employed.

Wash I-(2): A squeeze roller washing tank in which the lower half portion of the lower roller of a first pair of squeeze rollers disposed between the wash tank and the drying zone of the automatic processor was equipped to the processor was employed. An aqueous solution of 0.5 g/liter of disodium ethylenediaminetetraacetate dihydrate was first filled in the wash tank of the automatic processor and the squeeze roller washing tank.

Then, 100 sheets (each having a size of 10 inch×12 inch) of each of Photographic Materials 1 to 6 were subjected to running processing without supplying replenishers.

The volumes of the developer tank, the fix tank, and the wash tank were 11.5 liters, 11.5 liters and 6.5 liters, respectively, and the volume of the squeeze roller washing tank was 500 ml. The processing temperature and time for development, fixing and washing were 35° C. and 20 seconds, and 20° C. and 25 seconds, 35° C. and 20 seconds, and 20° C. and 15 seconds, respectively. The drying temperature was 50° C. Also the time of processing from dry to dry was 96 seconds.

The photographic properties obtained by the aforesaid process were as shown in Table 2 below.

TABLE 2

| Sample No. | Properties of Silver Halide Grains | | Swelling Percentage | Photographic Property: Fog | Photographic Property: Sensitivity(*1) | Photographic Property: Gradation | $S_2O_3^-$ Residue: Wash Processing I-(1) | $S_2O_3^-$ Residue: Wash Processing I-(2) |
|---|---|---|---|---|---|---|---|---|
| 1 | Grain Size 0.82μ | Potato-form | 230 | 0.03 | 100 | 2.85 | 0.008 | 0.148 |
| 2 | Grain Size 0.82μ | Potato-form | 100 | 0.03 | 82 | 2.43 | 0.012 | 0.041 |
| 3 | Aspect Ratio 7.1 | Tabular | 230 | 0.03 | 123 | 2.87 | 0.007 | 0.141 |
| 4 | Aspect Ratio 7.1 | Tabular | 150 | 0.03 | 114 | 2.84 | 0.010 | 0.068 |
| 5 | Aspect Ratio 7.1 | Tabular | 120 | 0.03 | 110 | 2.84 | 0.013 | 0.043 |
| 6 | Aspect Ratio 7.1 | Tabular | 70 | 0.03 | 105 | 2.84 | 0.018 | 0.010 |

(*1)Sensitivity is a relative value with the processing sensitivity of Sample 1 being taken as 100

As the measure for determining the washing extent for washing the photographic materials, the concentration of the thiosulfate remaining in the layer of each photographic material was measured as yellowing extent using a silver nitrate method of ISO 417-1977. In this Example, on the 100th sheet of 100 sheets thus processed, the aforesaid measurement was applied. The density of not more than 0.05 is the yellowing extent of giving substantially no problem for photographic materials stored for a long time under natural conditions.

From the results shown in Table 2 above, it can be seen that in the wash method I-(1) using a large amount of wash water, the washing efficiency becomes lower with the decrease of the swelling percentage of the photographic materials. On the other hand, in the wash method I-(2) provided with antifungal means, the washing efficiency is unexpectedly increased as the swelling percentage is lower.

Also, in the case of using Emulsion B (tabular grain silver halide emulsion), the photographic performance is not substantially sacrificed even by lowering the swelling percentage of the photographic material for improving the washing efficiency in wash with a small amount of wash water or washing with stock water. However, in the case of using Emulsion A containing silver halide grains of large size the reduction of the swelling percentage encounters other problems concerning the lowering of the photographic performance. That is, for obtaining the same photographic performance by lowering the swelling percentage to improve the washing efficiency, a large amount of silver is necessary. This is unsuitable for practical purpose.

EXAMPLE 2

Photorgraphic materials prepared in the same manner as shown in Example 1, were subjected to following Processing II.

| Processing II | |
|---|---|
| Developer Concentrate | |
| Potassium Hydroxide | 56.6 g |
| Sodium Sulfite | 267 g |
| Diethylenetriaminepentaacetic Acid | 6.6 g |
| Potassium Carbonate | 16.7 g |
| Boric Acid | 10 g |
| Hydroquinone | 83.3 g |
| Diethylene Glycol | 40 g |
| 4-Hydroxymethyl-4-methyl-1-phenyl-3-pyrazolidone | 11.0 g |
| 5-Methylbenzotriazole | 2 g |
| Water to make | 1 liter |
| pH adjusted to | 11.0 |
| Fix Concentrate | |
| Ammonium Thiosulfate | 700 g |
| Sodium Sulfite | 60 g |
| Disodium Ethylenediamine-tetraacetate Dihydrate | 0.10 g |
| Water to make | 1 liter |
| pH adjusted with acetic acid to | 5.10 |

| Automatic Processor | Processing Condition |
|---|---|
| Developer Tank 7.5 liters | 35° C. × 11.5 sec. |
| Fix Tank 7.5 liters | 35° C. × 12.5 sec. |
| Wash Tank 6.5 liters | 20° C. × 7.5 sec. |
| Squeeze Roller Washing Tank 0.3 liter | |
| Drying | 50° C. |
| Cooling water was not used for keeping the temperature of the developer and fix solution | |
| Dry to dry processing time | 50 sec. |

At starting the processing, the following processing solution was filled in each tank.

Developer Tank

A developer compsed of 333 ml of the aforesaid developer concentrate, 667 ml of water, and 10 ml of a starter containing 2 g of potassium bromide and 1.8 g of acetic acid, d said developer having a pH of 10.50.

Fix Tank

A fix solution composed of 250 ml of the above-described fix concentrate and 750 ml of water.

Wash Tank and Squeeze Roller Washing Tank

Aqueous solution as described in Wash I-(2) in Example 1.

Thereafter, each of of the photographic materials 1 to 6 was continuously subjected to running processing for 2 weeks with 50 sheets (each sheet having a size of 10 inch 2 12 inch) per day while automatically replenishing 20 ml of the developer concentrate and 80 ml of distilling water to the developer tank, 10 ml of fix concentrate and 30 ml of distilling water to the fix tank, and, and 60 ml of the aforesaid aqueous solution in Wash I-(2) from the squeese roller washing tank to the wash tank per processing one sheet of the photographic material.

The photographic performance obtained is shown in Table 3 below.

TABLE 3

| P.M.* | Photographic Properties | | | | |
|---|---|---|---|---|---|
| No. | Fog | Sensitivity | Gradation | Drying Property | Residual $S_2O_3$ |
| 1 | 0.03 | 95 | 2.55 | Drying poor | 0.166 |
| 2 | 0.03 | 73 | 2.38 | Drying poor | 0.073 |
| 3 | 0.03 | 118 | 2.95 | Drying poor | 0.157 |
| 4 | 0.03 | 111 | 2.87 | Poor in continuous Processing of More than 30 sheets | 0.066 |
| 5 | 0.04 | 105 | 2.85 | No Problem | 0.034 |
| 6 | 0.03 | 102 | 2.83 | No Problem | 0.008 |

Note:
*Photographic Material

From the results shown in Table 3, it can be seen that, in the case of photographic materials 4 to 6, the washing efficiency can be improved without reducing the photographic performance, even when the swelling percentage of the photographic materials is lowered.

Furthermore, as shown in this Example, processing can be effectively carried out without performing hardening in processing by reducing the swelling percentage of the photographic materials, non-plumbing processing becomes possible without causing problems of generating odor of the fix solution without need of the troublesome preparation for processing solutions. A large space for the replenisher tanks and the automatic processor as required in Wash I of Example 1, is also not needed.

EXAMPLE 3

(1) Preparation of Monodisperse Silver Halide Emulsion

After adding a proper amount of ammonia to a vessel kept at 55° C. containing gelatin, potassium bromide, and water, an aqueous silver nitrate solution and an aqueous potassium bromide solution containing hexachloroiridate (III) (so that the molar ratio of iridium to silver became $10^{-7}$ mol) were simultaneously added thereto by a double jet method in order to provide two kinds of monodisperse silver bromide emulsions containing silver halide grains each having a means grain size of 0.70 μm and 0.40 μm, respectively while changing the amount of ammonia added to the vessel. In each silver halide emulsion, 98% of the whole sivler halide grains existed within ±40% of the mean grain size. Also, in the latter term of the formation of the silver grains, potassium iodide of $1\times10^{-3}$ mol per mol of silver was added to each emulsion. After removing soluble salts from the emulsion, the pH and pAg were adjusted to 6.2 and 8.6, respectively. Then the emulsion was subjected to gold sensitization and sulfur sensitization with chloroauric acid and sodium thiosulfate to provide an emulsion having the desired photographic properties. The ratio of (100)-plane/(111)-plane of each emulsion measured by the Kubelka-Munk method was 93/7.

(2) Preparation of Coating Composition for Emulsion Layer

After melting the emulsion by heating a vessel containing 0.5kg of each of the two kinds of emulsions prepared above to 40° C., 30 ml of a methanol solution of the infrared region sensitizing dye ($9\times10^{-4}$ mol/-liter) having the formula shown below, 130 ml of an aqueous solution the supersensitizer ($4.4\times10^{-3}$ mol/-liter) having the formula shown below, 35 ml of a methanol solution of the storage stability improving agent ($2.8\times10^{-2}$ mol/liter) having the formula shown below, an aqueous solution of 4-hydroxy-6-methyl-1,3,3a,7-tetraazaindene, an aqueous solution of a dodecylbenzenesulfonate as a coating aid, and an aqueous solution of poly-potassium-p-vinylbenezenesulfonate compound as a thickening agent were added to each emulsion in order to provide a coating composition for emulsion layer.

(3) Preparation of Coating Composition for Surface Protective Layer for Emulsion Layer To an aqueous solution of 10% by weight gelatin heated to 40° C. were added an aqueous solution of sodium polystyrenesulfonate as thickening agent, fine particles of polymethyl methacrylate (mean particle size of 3.0 μm) as matting agent, N,N'-ethylenebis-(vinylsulfonylacetamide) as hardening agent, an aqueous solution of sodium t-octylphenoxyethoxyethanesulfonate as coating aid, an aqueous solution of a polyethylene series surface active agent as antistatic agent, and an aqueous solution of the fluorine-containing compounds shown below to provide a coating composition.

$C_8F_{17}SO_2N(C_3H_7)CH_2COOK$ and $C_8F_{17}SO_2N(C_3H_7)(CH_2CH_2O)_{15}H$

(4) Preparation of Coating Composition for Backing Layer

To 1 kg of an aqueous solution of 10% by weight gelatin heated to 40° C. were added an aqueous solution of sodium polystyrenesulfonate as thickening agent, 50 ml of an aqueous solution of a back dye ($5\times10^{-2}$ mol/-liter) having the formula shown below, an aqueous solution of N,N'-ethylenebis(vinylsulfonylactamide) as hardening agent, and an aqueous solution of sodium t-octylphenoxyethoxyethanesulfonate as coating aid to provide a coating composition.

(5) Preparation of Coating Composition for Surface Protective Layer for Baking Layer To an aqueous solution of 10% by weight gelatin heated to 40° C. were added an aqueous solution of sodium polystyrenesulfonate as thickening agent, fine particles of polymethyl methacrylate (mean particle size of 3.0 μm) as matting agent, an aqueous solution of sodium t-octylphenoxyethanesulfonate as coating aid, an aqueous solution of a polyethylene series surface active agent as antistatic agent, and an aqueous solution of the fluorine-containing compounds shown below to provide a coating composition.

$C_8F_{17}SO_2N(C_3H_7)CH_2COOK$ and $C_8F_{17}SO_2N(C_3H_7)(CH_2CH_2O)_{15}H$ (6) Preparation Of Coated Samples The aforesaid coating composition for backing layer was coated on one surface of a polyethylene terephthalate film support together with the coating composition for surface protective layer so that the gelatin coated amount became 4 g/m$^2$. Thereafter, the coating composition for emulsion layer and the coating composition for surface protective layer prepared above were coated on the opposite surface thereof so that the coated amount of silver became 3.4 g/m$^2$ while adjusting the amount of the hardening agent in the coating composition for protective layer so that the swelling percentage of the coated layers became 110%.

(7) Ordinary Sensitometer

The sample obtained in above step (6) was allowed to stand for 7 days under the conditions of 25° C. and 65% RH and then a scanning exposure of $10^{-7}$ second was applied to the sample using a semiconductor laser of 780 nm in wavelength at room temperature. Thereafter, the sample was processed as in Example 2.

The additives used for preparing the sample were as follows.

Infrared Sensitizing Dye:

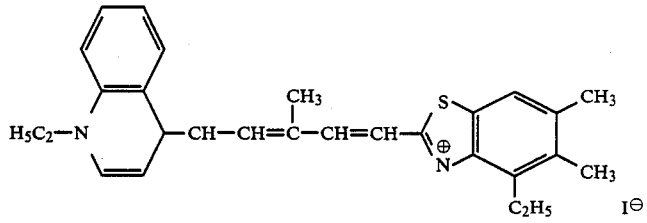

Super Sensitizer:

Disodium 4,4'-bis[2,6-di(naphthyl-4-oxy)pyrimidin2-ylamiol]-stilbene-2,2'-disulfonate.

Storing Stability Improving Agent:

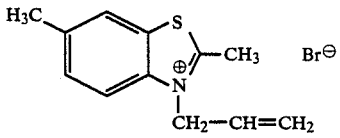

Back Dye:

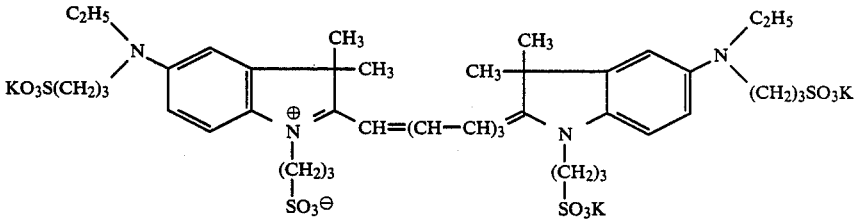

In this case, the following point differed from the case of Example 2.

The photographic films were continuously subjected to running processing for 2 months with 50 sheets (each sheet having a size of 25.7 cm×36.4 cm and a developing degree of 40%) per day by replenishing:

20 ml of the developer concentrate and 30 ml of stock tank water to the developer tank, 10 ml of the fix concentrate and a part (30 ml) of the overflow liquid from the wash tank to the fix tank, and 60 ml of stock tank water from the squeeze roller washing tank to the wash tank (to the direction opposite to the travelling direction of the sample) per processing one sheet of the photographic material.

When the yellowing extent by the thiosulfate remaining in the sample film after processed by running test of 2 months was measured, the yellowing extent was 0.036. Also, the washing property, drying property, and the photographic properties were also better.

EXAMPLE 4

To silver iodobromide emulsion containing cubic silver halide grains having a mean grain size of 0.3 μm containing 2.5 mol % iodide, were added a sodium salt of anhydro-5,5-dichlorol-9-ethyl-3,3'-bis(3-sulfopropyl-)oxacarbocyanine hydroxide (sensitizing dye) in an amount of 230 mg/mol-silver, a hydrozine derivative shown below in an amount of 1.3 g/mol-silver, and polyethylene glycol (molecular weight of about 1,000) in an amount of 300 mg/mol-silver. Furthermore, 5-methylbenzotriazole, 4-hydroxy-6-methyl-1,3,3a,7-tetraazaindene, a dispersion of polyethyl acrylate, and a sodium salt of 2-hydroxy-1,3,5-triazine were added to the emulsion. Still further, 1,3-divinylsulfonyl-2-propanol was added thereto so that the swelling percentage became 120%.

The coating composition thus prepared, was coated on a polyethylene terephthalate film support together with a protective layer so that the silver coated amount became 3.5 g/m$^2$ and the gelatin coated amount (of both the emulsion layer and the protective layer) became 3.0 g/m$^2$ to obtain a sample film.

Hydrazine Derivative:

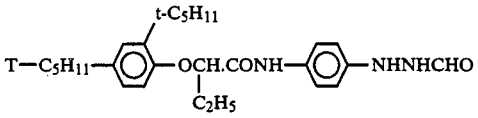

After exposure of the sample film through a sensitometric exposure wedge using a magenta contact screen of 150 lines, the film was developed with the developer shown below for 15 seconds at 40° C., fixed, washed and dried. The time of processing with the automatic processor from dry to dry was 65 seconds.

| Developer Composition | |
|---|---|
| Tetrasodium Ethylenediamine-tetraacetate | 1.0 g |
| Sodium Hydroxide | 9.0 g |
| 5-Sulfosalicyclic acid | 44.0 g |
| Potassium Sulfite | 100.0 g |
| 5-Methylbenztriazole | 0.5 g |
| Potassium Bromide | 6.0 g |
| N—Methyl-p-aminophenol. $\frac{1}{2}$ $H_2SO_4$ | 0.4 g |
| Hydroquinone | 54.0 g |
| Sodium p-Toluenesulfonate | 30.0 g |
| Water to make | 1 liter |
| pH | 11.7 |

The wash water having the same composition as the wash water used in Example 1 was used, and 250 ml of it was replenished per processing one sheet (20 inch×24 inch) of the sample films. The yellowing extent by the remaining thiosulfate of the processed films was 0.041.

EXAMPLE 5

In the washing process I-(2) of Example 1, the stabilizing solution (3) having the following composition was filled in the wash tank and the squeeze roller washing tank.

| | |
|---|---|
| Disodium Ethylenediamine-tetraacetate Dihydrate | 0.5 g |
| Sodium 2-Mercaptobenzimidazole-5-sulfonate | 0.02 g |
| Potassium Iodide | 0.5 g |
| Water to make | 1 liter |

Thereafter, 100 sheets of Photographic Material 5 in Example 1 were processed under the same conditions as in Example 1, except for the aforesaid stabilizing solution. Finally the photographic material was exposed to white light through a step wedge and were processed in order to provide samples for evaluating image stability.

That is, immediately after processing, the transmission density of the sample (i.e., one wedge was exposed at each stage) was measured and after storing the same for one weak at high temperature and high humidity (50° C. and 80% RH), the transmission density of the same at each stage was measured again. Thus, the reduction of density was measured at the stage nearest the density of 1.0 immediately after processing. The lower the density reduction, the better that image stability.

On the other hand, on the 100th sheet of the sample after processing 100 sheets and the residual ratio of the thiosulfate in the film was measured, as in Example 1.

The results obtained are as follows.

| Image Stability (reduction of density) | Residue of Sulfate |
|---|---|
| −0.03 | 0.043 |

The aforesaid image stability was almost the same as in the case of using a large amount of wash water.

In the process of this invention using the photographic material having low swelling percentage and a small amount of wash water, the silver images after processing are sufficiently stable in the case of processing wash water (stabilizing solution) containing a silver image stabilizer.

As described above, according to this invention, in the case of applying save water processing of using the replenisher for wash water of not more than 2 liters (including 0) per square meter of the silver halide photographic material, the washing efficiency is excellent and the image storage stability after processing is good.

Furthermore, drying property of the photographic materials in processing was good and hence quick processing is applicable.

While the invention has been described in detail and with reference to specific embodiments thereof, it will be apparent to one skilled in the art that various changes and modifications can be made therein without departing from the spirit and scope thereof.

What is claimed is:

1. A process for processing silver halide photographic materials which comprises processing, after development and fixing, the silver halide photographic materials with wash water or a stabilizing solution using a replenisher thereof of not more than 2 liters (including 0) per square meter of the photographic material and drying using a roller transporting type automatic processor, wherein the swelling percentage of the silver halide photographic material is not more than 200% and the total processing time from development to drying is not longer than 70 seconds.

2. The process for processing silver halide photographic materials as claimed in claim 1, wherein the silver halide emulsion for the silver halide photographic materials is a tabular grain silver halide emulsion containing tabular grains having a mean aspect ratio of 4 to 20.

3. The process for processing silver halide photographic materials as claimed in claim 1, wherein the swelling percentage of the silver halide photographic material is from 50% to 150%.

4. The process for processing silver halide photographic materials as claimed in claim 1, wherein the silver halide emulsion for the silver halide photographic materials is a tabular grain silver halide emulsion containing tabular grains having a mean aspect ratio of from 5 to 10.

5. The process for processing silver halide photographic materials as claimed in claim 1, wherein the silver halide emulsion for the silver halide photographic materials is a tabular grain silver halide emulsion containing tabular grains having a thickness of less than 0.3 μm.

6. The process for processing silver halide photographic materials as claimed in claim 1, wherein the silver halide emulsion for the silver halide emulsion containing tabular silver halide grains in an amount of at least 80% by weight, based upon the weight of the whole silver halide grains.

7. The process for processing silver halide photographic materials as claimed in claim 1, wherein the silver halide photographic materials contain silver in an amount of from 0.5 $g/m^2$ to 5 $g/m^2$ (per one side of the coated photographic material).

8. The process for processing silver halide photographic material as claimed in claim 1, wherein the developer does not contain a hardening agent.

9. The process for processing silver halide photographic materials as claimed in claim 1, wherein the washing or stabilizing temperature is from 0° to 50° C.

10. The process for processing silver halide photographic materials as claimed in claim 1, wherein the washing or stabilizing time is for a period of from 60 seconds to 6 seconds.

* * * * *